United States Patent [19]

Ranjan et al.

[11] Patent Number: 4,963,850

[45] Date of Patent: Oct. 16, 1990

[54] THERMAL WITHSTAND CAPABILITY OF A FILAMENT WOUND EPOXY FUSE BODY IN A CURRENT-LIMITING FUSE

[75] Inventors: Radhakrishnan Ranjan, Hickory; William E. Lazenby, Statesville, both of N.C.

[73] Assignee: General Electric Company, Malvern, Pa.

[21] Appl. No.: 330,630

[22] Filed: Mar. 30, 1989

[51] Int. Cl.[5] ..... H01H 85/143; H01H 85/38

[52] U.S. Cl. ..... 337/246; 337/273; 337/280

[58] Field of Search ..... 337/246, 273, 280, 199, 337/158, 159, 160, 276, 186

[56] References Cited

U.S. PATENT DOCUMENTS

| | | | |
|---|---|---|---|
| 1,570,864 | 3/1923 | Sinn . | |
| 1,692,138 | 3/1927 | Orr et al. . | |
| 1,895,022 | 1/1933 | Chandler | 138/109 |
| 2,870,295 | 1/1959 | Haroldson et al. | 337/246 |
| 3,111,567 | 11/1963 | Stewart et al. | 337/246 |
| 3,801,947 | 4/1974 | Blewitt et al. | 337/280 |
| 4,074,220 | 2/1978 | Santilli | 337/276 |
| 4,124,835 | 11/1978 | Cahill . | |
| 4,176,385 | 11/1979 | Dethlefsen . | |
| 4,373,556 | 2/1983 | Bergh | 337/186 |
| 4,417,226 | 11/1983 | Asdollahi et al. | 337/273 |
| 4,479,105 | 10/1984 | Banes . | |
| 4,486,734 | 12/1984 | Leach . | |
| 4,638,283 | 1/1987 | Frind et al. . | |

*Primary Examiner*—H. Broome

*Attorney, Agent, or Firm*—Henry J. Policinski; William H. Murray

[57] ABSTRACT

A fuse body encloses a fuse element of a current-limiting fuse wherein the fuse body is formed from an inexpensive material and provided with a shield between the inner surface of the fuse body and the fuse element. Thus, when the fuse element melts and arcs during interruption, the fuse body is protected from the hot gaseous arc products by the protective shield thereby preventing burning of the fuse body. The protective shield can be a spray coating such a ceramic spray coating applied to the inner surface of the fuse tube, a glass coating, or ceramic paper. The fuse body can be made from glass filament wound epoxy material.

13 Claims, 1 Drawing Sheet

THERMAL WITHSTAND CAPABILITY OF A FILAMENT WOUND EPOXY FUSE BODY IN A CURRENT-LIMITING FUSE

BACKGROUND OF THE INVENTION

The present invention relates to current limiting fuses used in electrical power distribution systems and particularly to improving the thermal withstand capability of the filament wound epoxy tube body of the fuse during long term low current interrupting conditions.

A current-limiting fuse consists of a fusible element wound on a core surrounded by clean sand or silica, contained inside an insulating tube. This tube can be made from a glass, ceramic or glass filament wound epoxy body depending upon the fuse design. The body made from filament wound epoxy tubing is economical and hence is popularly used. The fusible element melts on over-currents and creates an electric arc which burns inside the sand. This heat energy is absorbed by the melting sand or silica and the arc is quenched.

The fuse body must be capable of maintaining its mechanical and electrical characteristics at higher temperatures. The fuse while carrying its normal load current can be exposed to higher ambient temperatures up to 40° C. (as per ANSI/IEEE C 37.1940–1981). In addition, for general purpose current limiting fuses, the fuse body temperature could rise during melting on long term low currents. In addition, the arcing inside the sand adds to the heat input. The arcing times are longer at lower available currents.

In a full range power force described in U.S. Pat. No. 4,638,283, in addition to the heating of the tube due to arcing, the chemical charges which are located along the length of the element fire and add heat to the system. Thus the energy dumped is higher than the conventional general purpose fuses and the fuse body should be capable of withstanding these thermal stresses.

The current rating of a current-limiting fust as defined by ANSI/IEEE C 37. 40-1981, is dependent on the maximum temperature withstand capability of the fuse body. This limits the maximum current rating in a particular body size of a fuse The fuse design engineer cannot use all the available temperature withstand capability of the fuse body to increase its current rating because of the thermal withstand requirements during interruption of long term low currents described above.

The present market trend in current-limiting fuses is toward low cost, higher current rated fuses in smaller body sizes. This requires the use of filament wound epoxy tubing rather than glass or ceramic tubes The ceramic or glass tubing does not burn during the excess heat period, described above, while the low cost filament wound epoxy tubes tend to burn when used in designs where the arcing occurs close to the fuse body. Thus the distance between the fusible element and the body determines the current rating or the body size of a fuse. In the chemically augmented fuses, this is more critical because of the chemical charges located on the elements.

It is therefore the object of the present invention to shield the fuse body of a current-limiting fuse from the hot gases of an electric arc or from the firing of the chemical charge and permit the fuse element to be positioned closer to the fuse body to permit a smaller fuse.

It is a further object of the invention to shield and protect a fuse body formed of a low cost inexpensive material normally prone to burning when it is exposed to direct flow of hot gases.

These and other objects of the present invention are obtained by providing a ceramic shield which can withstand a very high temperature gradient to protect the inner surface of the filament wound epoxy body of a low cost fuse tube.

Other objects, features and advantages of the present invention will be more fully apparent from the following detailed description of the preferred embodiment, the appended claims and the accompanying drawings.

SUMMARY OF THE INVENTION

A current-limiting fuse using an inexpensive fuse body made from a glass filament wound epoxy material has a protective shield between the inner surface of the fuse body and the fusible element for surrounding but not entirely enclosing the fusible element. This protective shield is capable of withstanding high thermal gradients across its thickness. When the fusible element melts open and arcs during the over-current the fust body is protected from the hot arc products of the electric arc and hot gases from the firing of chemical charges. The possibility of burning is thus minimized and the hot gas is not contained within the shield. This protective shield can be a spray coating such as a ceramic spray coating applied to the inner surface of the tube, a glass coating or ceramic paper. Thus this shield permits the use of a filament wound epoxy body which is low in cost compared to glass or ceramic bodies, and reduces the material cost of current-limiting fuses. Additionally, it permits the inner surface of the fuse body to be positioned closer to the fuse element thereby permitting the production of fuses which may be rated at higher currents in a smaller body size.

DETAILED DESCRIPTION OF THE INVENTION

Figure 1:
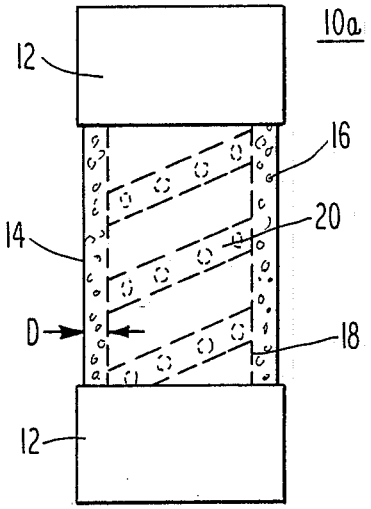
PRIOR ART Fig. 1
FIG. 1 shows a current-limiting fuse having a prior art fuse body.

Referring now to FIG. 1, there is shown a current-limiting fuse 10*a*. Current-limiting fuse 10*a* includes two conducting ferrules 12 at opposite ends of a tubular fuse body 14. Within tubular body 14 of current-limiting fuse 10*a*, a fuse core 18 is concentrically disposed Fuse element 20 is helically wound around fuse core 18 and is electrically coupled at opposite ends to respective conducting ferrules 12 to provide a current path between the two conducting ferrules 12. When the current through the fuse element 20 exceeds its minimum melting current rating of fuse 10*a*, the fuse element 20 melts open and breaks the current path between the conducting ferrules 12 and creates an electric arc across the opening in element 20 The space between the inner surface of the fuse tube 14 and the center of the core 18 is filled with sand or silica particles 16. Sand or silica particles 16 surround the core 18 as well as fuse element 20. When fuse element 20 melts and creates an electric arc, sand or silica particles 16 melt and thereby absorb the arc energy released and interrupt the current path by quenching the arc. In order to protect the fuse body 14 from the hot arc products, a critical distance D is maintained between fuse body 14 and fusible element 20 In chemically augmented fuses, in addition to the hot arc products, the hot gases from the chemical charge firing necessitates a larger critical distance D. Thus distance D limits the body size of a fuse for a particular rating.

If the critical distance D is reduced for producing a smaller body size fuse 10*a*, the hot gases from the arc products or from the firing of the chemical charge firing can cause partial burning of fuse tube 14, producing carbon deposits inside fuse 10*a*. These carbon deposits cause partial breakdown by the treeing effect and may result in the failure of fuse 10*a*. Inadequate or improper sand fill can cause the formation of a bigger fulgurite or molten sand which could come closer to the fuse body 14 and cause partial burning Thus, it is required that fuse tube 14 be made from non-burnable inorganic materials such as glass or ceramic which are expensive and require heavier ferrules 12.

Figure 2:
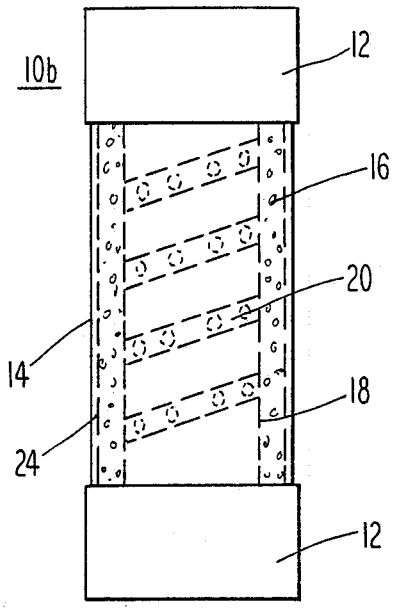
FIG. 2 shows a current-limiting fuse having the fuse body of the present invention.

Referring now to FIG. 2, there is shown a current-limiting fuse 10*b* which includes a low cost fuse body 14 with a protective shield 24 of the present invention. Protective shield 24 is preferably formed of inorganic material such as glass, ceramic or the like which is applied as a cover to the inner surface of the fuse body 14 to shield it from the hot gases produced by the electric arc or by the firing of the chemical charge. The protective shield withstands the high thermal gradients and protects the inexpensive fuse body 14 from burning. In this method, the material cost of the fuse can be reduced and fuses of a particular rating can be produced in a physically smaller body size.

Figure 3:
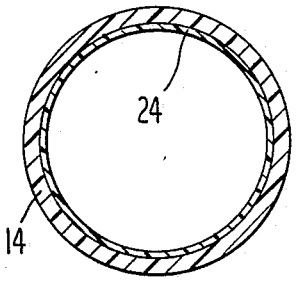
FIG. 3 shows a cross-sectional view of the fuse body of FIG. 2 including the protective shield of the present invention.
Figure 4:
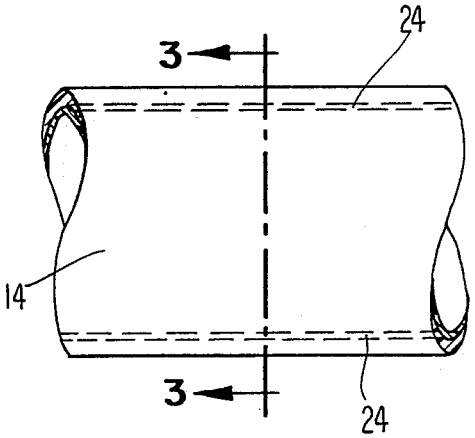
FIG. 4 shows a side view of the fuse body of FIG. 3.

FIG. 3 and FIG. 4 detail the structure of protective shield 24 inside the fuse body 14. Protective shield 24 may be applied to the inner surface of fuse tube 14 by means of conventional spray ceramic coating or spray plastic coating. A protective shield having a thickness of approximately one sixteenth of an inch provides good protection for fuse body 14 and permits critical distances D of approximately one quarter of an inch to three eighths of an inch Alternatively, a thin ceramic paper can be formed into a tube shape and the ceramic paper tube disposed concentrically within the fuse tube 14 and substantially close to the inner surface of fuse tube 14. Sand or silica particles 16 filing the space inside the fuse 10*b* hold the ceramic paper shield 24 against the inner surface of fuse body 14. Thus the ceramic paper protective shield 24 provides the same protection to the inner surface of the fuse tube 14 as spray ceramic coating of the inner surfact of the fuse tube 14. Additionally, protective shield 24 may be formed of high temperature resistant heat shield material such as that used to form the heat shields of re-entry space crafts such as the space shuttle.

It should be understood that various changes in the details, materials and arrangements of parts which have been described and illustrated in order to explain the nature of this invention may be made by those skilled in the art without departing from the principle and scope of the invention as expressed in the following claims.

We claim:

1. A device for enclosing a fuse element of a current-limiting fuse wherein thermal energy and hot gases are generated during triggering of said fuse element comprising, a fuse body and a protective shield adapted to resist the high temperature of said thermal energy without thermal breakdown, said shield separate from said fuse body and surrounding without enclosing said fuse element for protecting the inner surface of said fuse body from burning due to said generated thermal energy only by shielding said fuse body from said thermal energy wherein said high temperature resistant protective shield is adapted to permit escape of said hot gases from within said shield.

2. The fuse body of claim 1, wherein the said protective shield is formed of ceramic paper.

3. The fuse body of claim 1, wherein said protective shield is formed of plastic.

4. The fuse body of claim 1, wherein said fuse body is formed of glass filament wound epoxy.

5. An improved current-limiting fuse for use in an electric power distribution system said fuse generating thermal energy and hot gases when triggered, comprising:

a fuse core, a fuse element wound around substantially the entire length of said core, a fuse body surrounding said fuse core and positioned concentrically with said fuse core, conducting end cap ferrules, each disposed at a respective end of said fuse body for enclosing said respective ends of said fuse body and each end cap ferrule electrically coupled to a respective end of said fuse element, and a protective shield adapted to resist the temperature of said thermal energy without thermal breakdown, said shield separate from said fuse body and disposed between said fuse body and said fuse element surrounding without enclosing said fuse element and adapted to protect said fuse body from burning due to said thermal energy only by shielding said fuse body from said thermal energy and to permit escape of said hot gases from within said protective shield.

6. The improved current-limiting fuse of claim 5, wherein said protective shield is ceramic paper.

7. The improved current-limiting fuse of claim 5, wherein said fuse body is formed of glass filament wound epoxy.

8. The improved current-limiting fuse of claim 5, wherein said high temperature resistant protective shield is adapted to permit escape of said hot gases by forming said high temperature resistant protective shield in a tubular shape having openings in the shielding material at the ends of said tubular shape for said hot gasses to pass through said openings.

9. The improved current-limiting fuse of claim 8, wherein said shield surrounds said fuse element along substantially the entire longitudinal length of said fuse element and the ends of said fuse element are disposed near respective openings of said shield.

10. The improved current-limiting fuse of claim 5, wherein said shield comprises a single unitary structure.

11. The fuse body of claim 1, wherein said high temperature resistant protective shield is adapted to permit escape of said hot gases by forming said high temperature resistant protective shield in a tubular shape having openings in the shielding material at the ends of said tubular shape for said hot gases to pass through said openings.

12. The fuse body of claim 11, wherein said shield surrounds said fuse element along substantially the entire longitudinal length of said fuse element and the ends of said fuse element are disposed near respective openings of said shield.

13. The fuse body of claim 1 wherein said shield comprises a single unitary structure.

* * * * *